US005368284A

United States Patent [19]

Renth

[11] Patent Number: 5,368,284

[45] Date of Patent: Nov. 29, 1994

[54] ROLL FEED APPARATUS

[75] Inventor: Lawrence B. Renth, Yukon, Okla.

[73] Assignee: I G Incorporated, Oklahoma City, Okla.

[21] Appl. No.: 113,183

[22] Filed: Aug. 30, 1993

[51] Int. Cl.[5] ..... B65H 3/08

[52] U.S. Cl. ..... 271/5; 83/76.1; 83/436; 83/639.1; 271/238; 271/240

[58] Field of Search ..... 271/3, 5, 10, 11, 13, 271/30.1, 31, 240, 238; 83/76.1, 156, 436, 444, 446, 449, 639.1

[56] References Cited

U.S. PATENT DOCUMENTS

| | | | |
|---|---|---|---|
| 1,029,159 | 6/1912 | Westerbeck | 271/240 |
| 2,347,254 | 4/1944 | Cox | 271/11 X |
| 3,990,335 | 11/1976 | Morse | 83/156 X |
| 4,002,332 | 1/1977 | Hoenigmann | 271/11 |
| 4,212,263 | 7/1980 | Hillhouse | 271/5 |
| 4,511,131 | 4/1985 | Raybuck | 270/54 |
| 4,555,966 | 12/1985 | Klingel | 83/76.1 |
| 4,750,660 | 6/1988 | Kamimura | 271/240 X |

*Primary Examiner*—Richard A. Schacher
*Attorney, Agent, or Firm*—Dougherty, Hessin, Beavers & Gilbert

[57] ABSTRACT

A roll or strip feed system for inserting flat stock to the operative position of a machine tool consisting of an automatic material lift apparatus working in conjunction with a centralizing guide to feed flat stock intermittently into an entry guide roller which pushes strip stock to an operative machine position, and thereafter, pulls the remnant strip by means of exit rollers to a discard position. The roller assemblies are pneumatically controlled as to tension and driven electrically as the total operation is under control of a pre-programmed controller.

13 Claims, 4 Drawing Sheets

ROLL FEED APPARATUS

BACKGROUND OF THE INVENTION

1. Field of the Invention

The invention relates generally to apparatus for feeding flat stock to a coactive machine such as a punch press or other device requiring intermittent or continuous feeding of input stock.

2. Description of the Prior Art

The prior art includes numerous types of stock feeding apparatus for use with press equipment and other similar types of operation that require repetitive feeding of selected stock for processing. While there are a number of existing feeder devices for large, thick stock and especially feed stock that is contained in coiled strip form, the present invention offers distinct improvements in press feeders for handling relatively thin, lightweight stock, and especially flat segments or bar stock that is fed in incrementally as successive strips are entered into the feed. The present equipment then has the capability for press feeding either strip or coil stock for either continuous or intermittent operation.

SUMMARY OF THE INVENTION

The present invention relates to improvements in press feeding equipment and, more particularly, it relates to a roll feed system which accepts the stock strip and, under entry roller control, moves the stock strip through the operating work area of the press feeder or other device, whereupon the output remnant strip is controlled by an exit roller. In the case of successive strips of input stock, the entry guide feeder controls movement of the stock strip through the operating position, and once the strip runs out of the entry guide roller, the exit guide roller continues the indexing and moving of the stock strip through completion of the work operation and discard of the remnant stock strip. A centralizing guide unit assures that the stock strip materials will enter the machine at a preset location whether segmental strip or coiled stock strip is utilized. In the case of segmental strip stock, a material lift unit feeds strip stock materials either horizontally or inclined into the rollers of the entry guide stage. A control processor is utilized to coordinate the roller drives and other miscellaneous functions of the system, and the control processor is controlled by a specific computer program.

Therefore, it is an object of the present invention to provide a strip stock feeder which is capable of feeding either segmental or coiled strip stock.

It is also an object of the present invention to provide a flat stock feeder apparatus that operates with greater precision and, therefore, less waste of stock material.

It is yet another object of the invention to provide strip stock feeder apparatus that functions reliably at considerably higher stock feed speeds.

Finally, it is an object of the present invention to provide stock feeder apparatus that is capable of a wide range of feed operations from lightweight roll materials through relatively heavy materials with feed stock supplied in either strip segments or coiled strip form.

Other objects and advantages of the invention will be evident from the following detailed description when read in conjunction with the accompanying drawings which illustrate the invention.

DETAILED DESCRIPTION OF THE INVENTION

Figure 1:
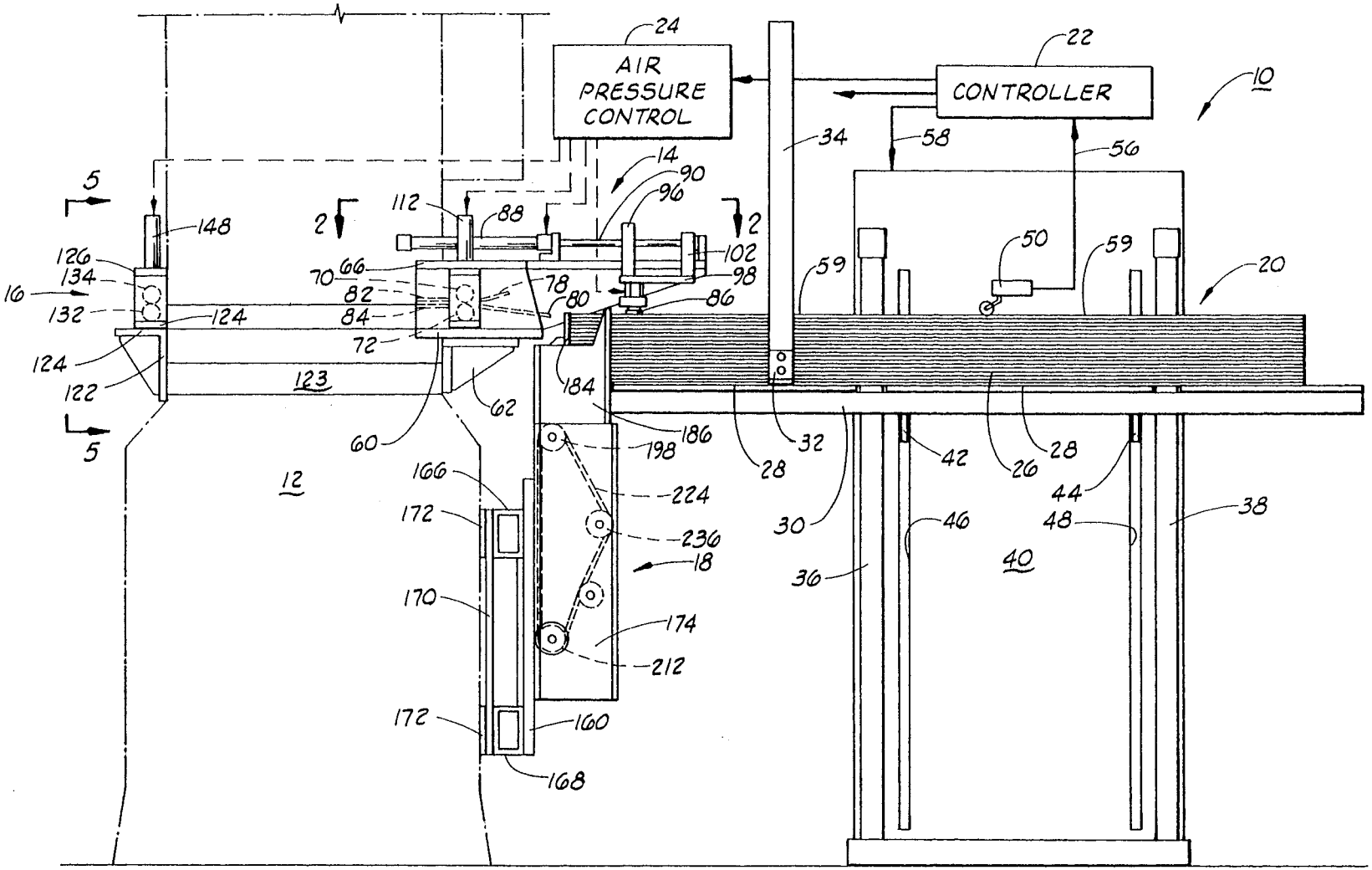
FIG. 1 is a pictorial view in side elevation of the overall stock feeder system as used in conjunction with a punch press.

FIG. 1 illustrates a roll feed system 10 which functions to feed all kinds of strip or coiled stock automatically into, e.g., a punch press 12, or any other device that requires intermittent or continuous feed motion. A roll feed entry 14 functions to introduce strip materials into rollers which are controlled under air pressure to assure proper squeeze tension on the strip material so that any slippage is avoided during the feed cycle. A roll feed exit structure 16 takes over the strip movement of material when the tail end of a strip exits the entry rollers of roll feed entry 14. When feeding coiled stock, either the roll feed entry 14 or the roll feed exit 16 can be relied on, depending upon whether pushing or pulling of the material is required.

A centralizing guide 18 assures that materials will enter the feed at a preset location, and the strip or coil width is readily adjustable by means of a hand wheel while maintaining centralized entry. A material lift 20 is employed for the strip-feed applications and it is a matter of choice as to whether the materials are fed horizontal or on the incline as sometimes may be required. A controller 22 functions under control of a specific program to coordinate all roller drive motors and miscellaneous air control functions required around the total system. An air pressure source 24 provides multiple air line regulations under control of controller 22.

Referring again to FIG. 1, the material lift 20 is employed for the strip feeding operation. In the case of coiled stock feed, the system would use a well-known type of coil support with the input adjustably controlled for insertion at roll feed entry 14. In the strip feed mode, a plurality of strips 26 of material which are to be fed individually into the punch press 12 are stacked on a feed plate 28 which is secured along a lift shelf 30. A pair of oppositely disposed brackets 32 are adjustably secured on plate 28 with upright guide rails 34 secured thereto. The guide rails 34 are secured on each side of the stack of strips 26 to maintain the stack in alignment as they are retained on top of lift shelf 30.

The lift shelf 30 is slidable vertically on polish rails 36 and 38 disposed on the forward wall 40 of the material lift 20. A pair of lift arms 42 and 44 extend outward through vertical spaces 46 and 48 for attachment to the underside of lift shelf 30. Thus, a limit-type switch 50 is adjustably fixed to sense the upper surface of strips 26, and to provide input via line 52 to the controller 22. Controller 22 is then responsive to provide control output on line 58 to cause upward incremental movement of lift arms 42 and 44 thereby to index the strips 26 into position for moving the next succeeding or top strip 59 into the roll feed entry 14. The system is totally adjustable for length and width of the strips 26 as well as the height of the strip 26 stack on plate 28.

Figure 2:
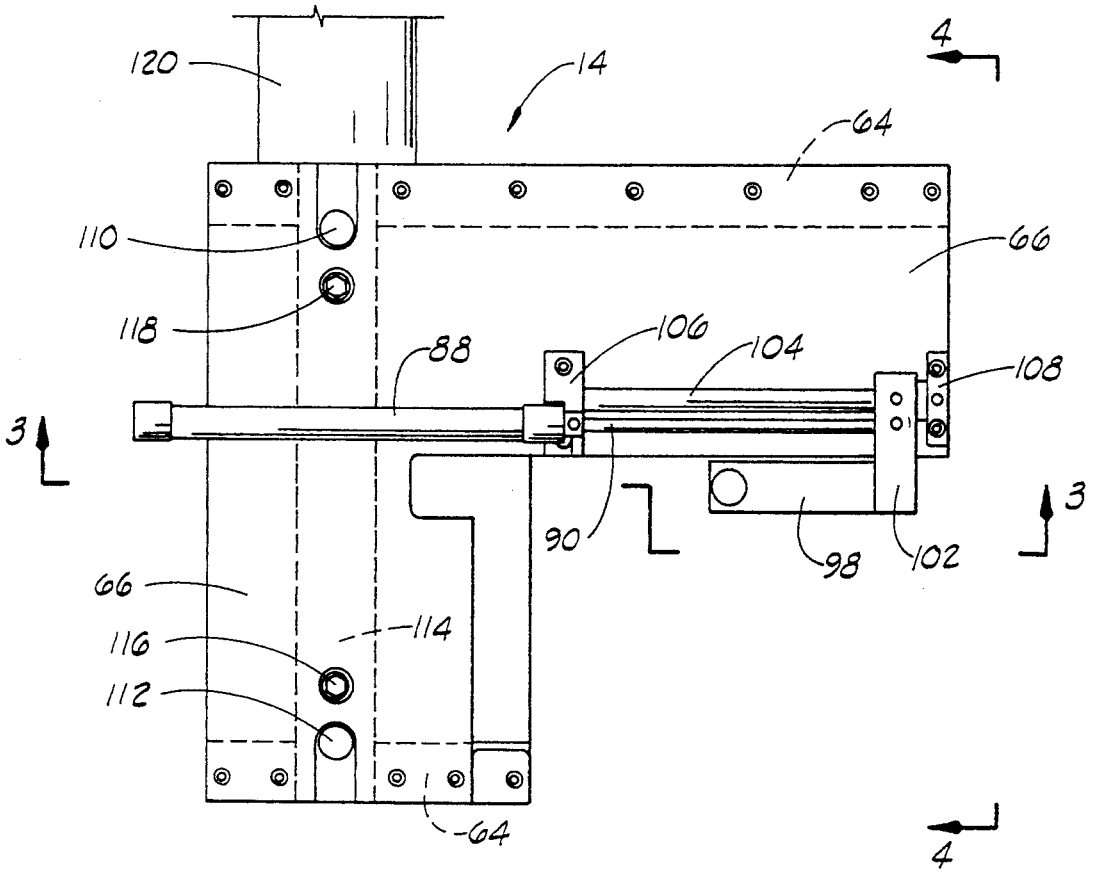
FIG. 2 is a top plan view of the roll feed entry section of the system.
Figure 3:
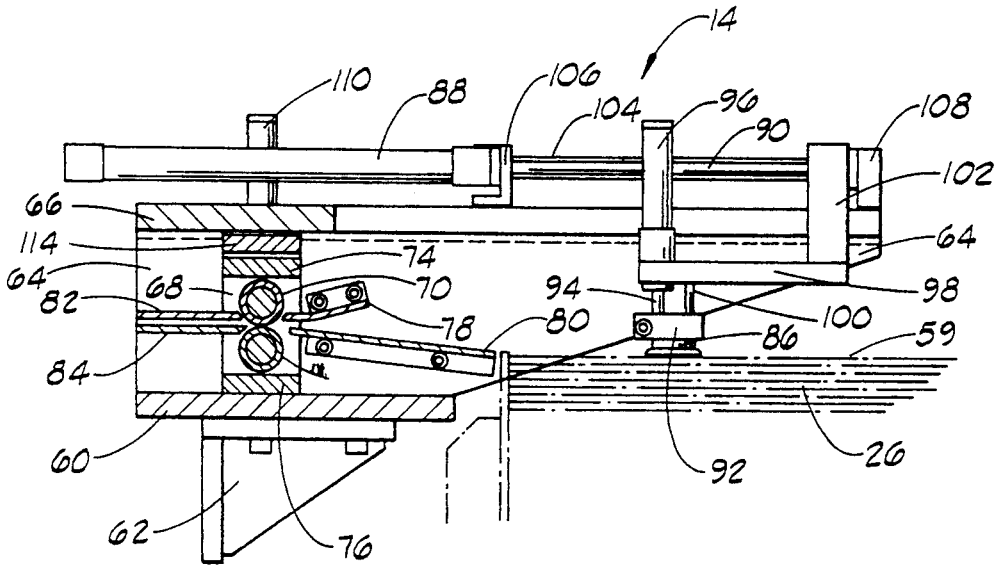
FIG. 3 is a section taken along lines 3—3 of FIG. 2.
Figure 4:
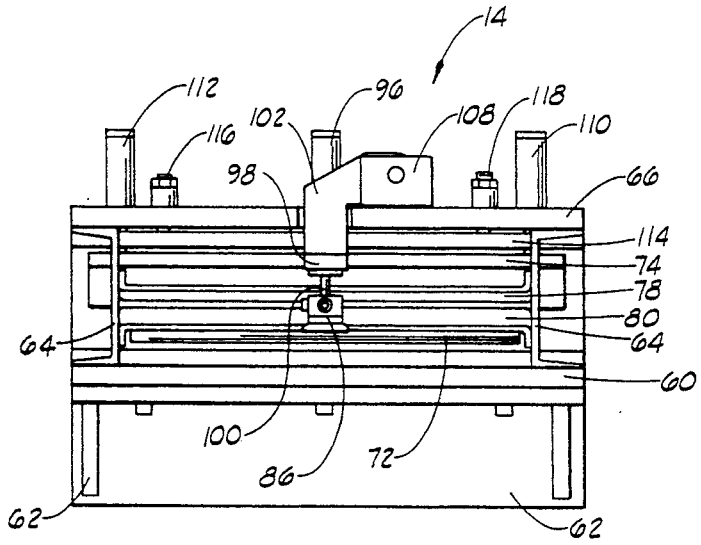
FIG. 4 is a section taken along lines 4—4 of FIG. 2.

FIGS. 2, 3 and 4 depict the roll feed entry 14. The feed entry 14 includes a horizontal base plate 60 which is secured on a bracket shelf 62 affixed in proper alignment on the associated punch press 12. Channels 64 provide vertical support from base plate 60 while a top plate 66 is suitably secured thereon parallel to base plate 60. A roll assembly 68 consisting of upper roller 70 and lower roller 72, adjustably retained adjacent respective tension plates 74 and 76, is rigidly retained between base plate 60 and top plate 66. Strip input is fed between upper entry guide 78 and lower entry guide 80 whereupon a strip 26 (top strip 59) is drawn through the tensioned rollers 70 and 72 and then the strip 26 is directed through an upper guide plate 82 and lower guide plate 84.

The individual stock strips 26 are picked up and placed on the lower entry guide 80 by a vacuum cup 86 which is mounted for longitudinal travel as controlled by an air cylinder 88 and piston rod 90. The vacuum cup 86 is connected by means of a clamping adapter 92 to receive pressure flow via tube 94 from an air cylinder 96, a Clippard Type SDR-12 (one inch stroke). The air cylinder 96 is mounted vertically on a support arm 98 which also extends a vertical dowel 100 that guides the clamping adapter 92 in proper position. The support arm 98 is then secured to a lateral elbow carriage 102 which is rigidly secured to the end of piston rod 90 and which includes a close-fitting hole that slides along polished rod 104 secured between clamp brackets 106 and 108. Thus, and referring to FIG. 3, when air cylinder 96 is actuated to the pickup mode, the vacuum cup 86 raises the topmost strip 59 upward about one-half inch whereupon air cylinder 88 is then actuated to retract piston rod 90 and move elbow 102 along the polish rod 104 as support arm 98 moves inward. This action brings the topmost strip 59 through the entry guides 78 and 80 and into engagement in rollers 70 and 72, and cylinder 96 is controlled to release the vacuum applied through vacuum cup 86 after which cylinder 88 returns to its fully extended piston position, as shown.

Referring again to all of FIGS. 2, 3 and 4, a pair of oppositely disposed air cylinders 110 and 112, Clippard Type SDR-12, control gripping and release of top roller 70. Gross adjustment of roller tension is provided by a slide bar 114 positioned by opposite side tension bolts 116 and 118. The rollers 70 and 72 are powered by a selected gear motor 120 which is suitably mounted on a side channel 64 with direct output engagement to drive the rollers 70 and 72. Gear motor 120 is an electric Compumotor type SX 135 available from Tektronix Inc. of Edmond, Okla. While a single line air feed is shown for the several air cylinders in FIG. 1, it should be understood that each of the air cylinders 88, 110 and 112 is fitted with an air connection at each end of the respective cylinders and the suction pick-up air cylinder 96 receives but a single air connection from the return or bottom side since it exercises only a suction function.

Figure 5:
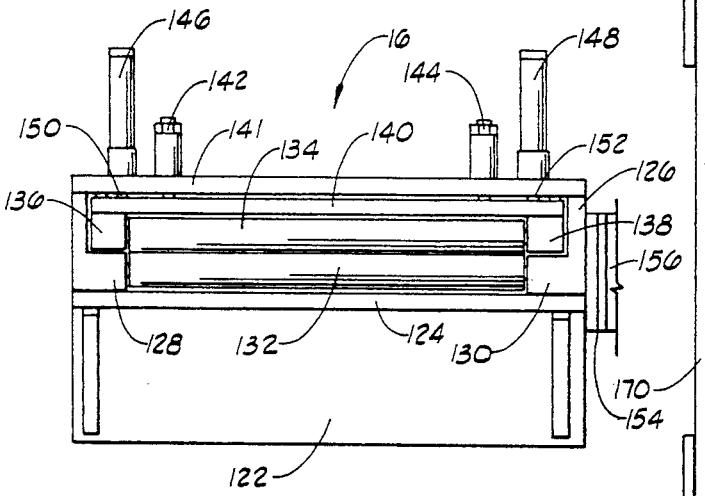
FIG. 5 is a front view in elevation of the roll feed exit structure.

Referring now to FIG. 5, the roll feed exit assembly 16 is supported by a suitable bracket shelf 122 which supports an exit roller assembly 124 as affixed to the rear side of the operating machine 12 (FIG. 1). A suitable bolster 123 may be connected around press 12 between opposite side bracket shelf assemblies 62 and 122. The shelf plate 124 supports opposite side blocks 128 and 130 which provide sealed ball bearing supports for the opposite sides of lower roller 132. The upper roller 134 is supported by opposite side bearings housed in respective slide blocks 136 and 138 which are rigidly secured to a slide bar 140 extending across the assembly. Gross adjustment of the height of slide bar 140 is made by adjustment nuts 142 and 144, and instantaneous control of slide bar 140 is exercised by air cylinders 146 and 148 (Clippard Type SDR-12). Thus, the cylinders 146 and 148 are connected with respective piston rods 150 and 152 affixed to the upper side of slide plate 140. Although not shown, the air cylinders 146 and 148 receive air pressure lines for pressure and return to the top and bottom of respective air cylinders as they are controlled from air pressure source 24 (FIG. 1). A mounting plate 154 provides support for a roller control gear motor 156 which is connected through a suitable bearing mounted coupling (not shown) within the block 130. Gear motor 156 is also a type SX 135 Compumotor.

Figure 6:
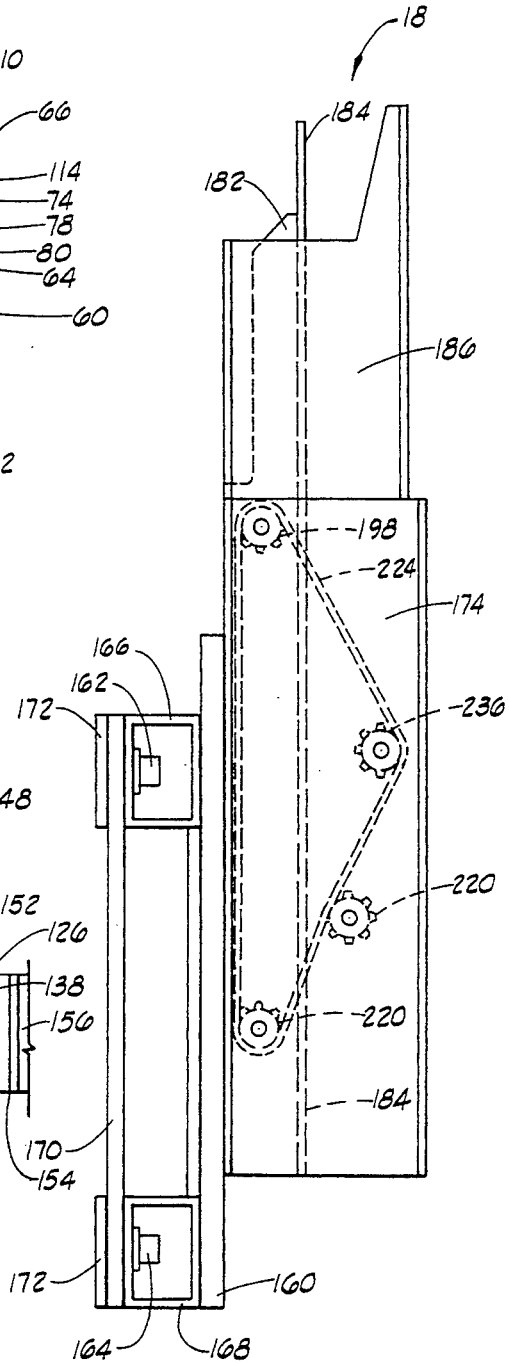
FIG. 6 is a side view in elevation of the centralizing guide section of the apparatus.
Figure 7:
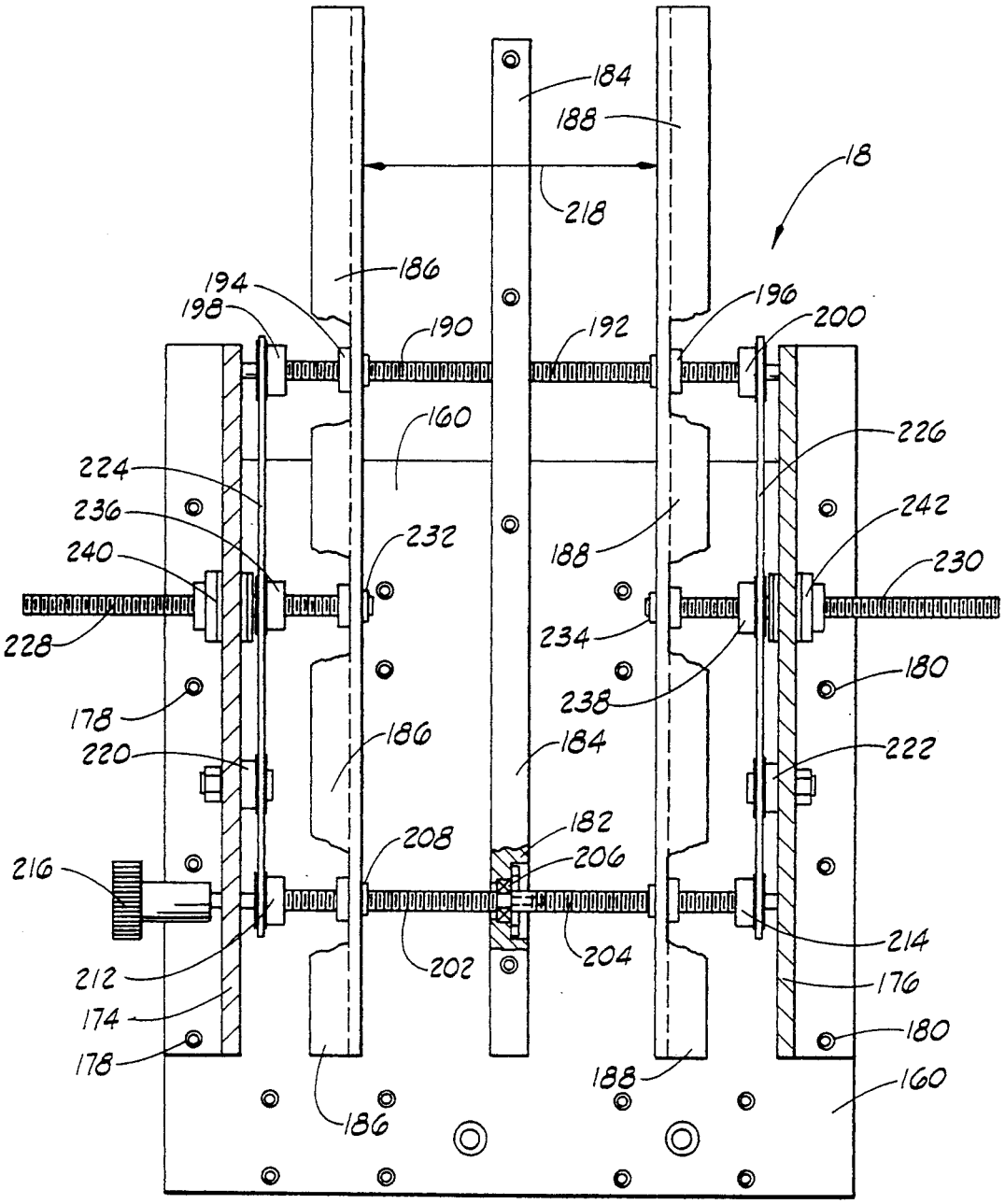
FIG. 7 is a front view in elevation of the centralizing guide.

FIGS. 6 and 7 depict the centralizing guide 18. The centralizing guide 18 is rigidly mounted on the side of the punch press 12 (FIG. 1) by means of mounting assembly 160 as secured by mounting bolts 162 and 164. Weldment tubes 166 and 168 are secured to the press 12 at the requisite height by securing the mounting bolts 162 and 164 through a mounting plate 170 and shims 172. The mounting plate 160 is then affixed as by welding onto the weldment tubes 166 and 168. An adjustable rail array is secured on mounting plate 160 which array consists of side rails 174 and 176 formed from angle metal, and each is rigidly secured to the baseplate 160 by means of respective pluralities of bolts 178 and 180. A central stop rail 182 is also rigidly affixed to the base plate 160 as it carries an insert strip 184 bolted vertically therealong.

Guide rails 186 and 188, angle metal members, are each aligned with a flat side inward and adjustable to provide a guide surface for strip stock that is aligned to pass over the insert plate 184 and into the operative position of punch press 12 (FIG. 1). Oppositely threaded lead screws 190 and 192 are threaded through respective lead screw nuts 194 and 196 that are rigidly affixed in the guide rails 186 and 188. The lead screws 190 and 192 extend outward into engagement with respective sprockets 198 and 200 to terminate in a journal mount within the opposite side rails 174 and 176. Similarly, at the lower end the oppositely threaded lead screws 202 and 204, as rotatable through a locking bearing assembly 206, are threadedly received through respective lead screw nuts 208 and 210 as affixed in respective guide rails 186 and 188 and the lead screws extend into connection with respective sprockets 212 and 214 and journal support in the side rails 174 and 176, respectively. The lead screw 202 extends through side rail 174 into engagement with a hand wheel 216 which provides adjustment of the gap or guide space indicated by arrow 218. That is, the positioning of strip or coil material is readily adjustable to any width by means of hand wheel 216 while the centralizing guide 18 maintains centralized entry of strip material into the punch press 12.

A pair of pre-adjustable idler sprockets 220 and 222 serve to maintain proper tension on respective interconnecting chains 224 and 226 which function to rotate the oppositely threaded lead screws in even, coordinated rotation. Yet another set of oppositely threaded lead screws 228 and 230 are disposed to move the outer reaches of guide plates 186 and 188 relative to the respective side rails 174 and 176. Thus, lead screws 228 and 230 are journaled in the guide rails 186 and 188 within respective bearings 232 and 234, and the lead screws 228 and 230 are threadedly received through respective sprockets 236 and 238 which are keyed to respective bushing assemblies 240 and 242.

The various coordinated movements of the apparatus including motor driven rollers and the various air pressure actuations, are controlled by the pre-programmed controller 22. The controller 22 may be such as a Compumotor 6000 Controller which is commercially available from Tektronix Inc. of Edmond, Okla. The controller 22 is programmed to function through air pressure control 24 to control the timely actuation of the air cylinders 96, 110, 112, 148 and 146. Suitable air control units consisting of solenoid actuated pneumatic valves are also commercially available from Tektronix Inc.

The processing control program is as follows:

```
Program Name: XD1

Program Text:

XE1
XD1
STO
1CCS3
1SIM3
LD3
XT

Program Name: START

Program Text:

STARTP CHOICE
DEL CHOICE
DEF CHOICE
OUT0000
LH0,0
PULSE1.0,1.0
DRES4000,4000
DCLEAR0
A70,70
AD70,70
V80,80
DLED10000000
DPCUR1,5
DWRITE"TO RUN STRIPS PRESS F1"
DPCUR2,5
DWRITE"TO RUN COILS PRESS F2"
VAR1=DREADF
IF(VAR1=1)
GOTO STRIPS
NIF
IF(VAR1=2)
GOTO COILS
NIF
END
DEL STRIPS
DEF STRIPS
DCLEAR0
DPCUR1,1
DLEDX1000000
DWRITE"ENTER LENGTH OF PART"
DPCUR1,22
VAR2=DREAD
DPCUR2,1
DWRITE"ENTER DISTANCE BETWEEN PARTS"
DLEDXX1XXXXX
DPCUR2,30
VAR3=DREAD
VAR4=VAR2*6175
VAR5=VAR3*6175
VAR6=VAR4+VAR5
VAR8=VAR6/2
VAR9=VAR8+81200
VAR10=82000
VAR11=62500
GOTO PICK
```

-continued

```
END
DEL PICK
DEF PICK
DCLEAR0
DPCUR1,1
DWRITE"PUSH F1 TO RUN SINGLE"
DPCUR2,1
DWRITE"PUSH F2 TO RUN AUTO"
DLEDXXX1XXXX
VAR7=DREADF
IF(VAR7=1)
GOTO SINGLE
NIF
IF(VAR7=2)
GOTO AUTO
NIF
END
DEL SINGLE
DEF SINGLE
DCLEAR0
DPCUR1,5
DWRITE"SINGLE STROKE"
DPCUR2,5
DWRITE"HAND OPERATE"
REPEAT
OUT1X1X
DLEDXXXX1X1X
T1.5
OUTX1XX
DLEDXXXXX1XX
T1.5
OUT0XXX
DLEDXXXX0XXX
T.5
OUTX0XX
DLEDXXXXX0XX
D(VAR9),0
GO
PSET0,0
UNTIL(IN=B10)
GOTO SMAKE
END
DEL SMAKE
DEF SMAKE
OUT1XXX
T.2
OUT0XXX
REPEAT
WAIT(IN=B00)
D(VAR6),(VAR6)
GO
UNTIL(2PM>VAR10)
OUT1X0X
DLEDXXXX1X0X
REPEAT
WAIT(IN=B00)
GO
UNTIL(IN=B11)
PSET0,0
REPEAT
VAR12=2PM+VAR6
WAIT(IN=B01)
GO
UNTIL(VAR12>VAR11)
D0,100000
GO
OUT0XXX
DLEDXXXX0XXX
GOTO STRIPS
END
DEL AUTO
DEF AUTO
DCLEAR0
DPCUR1,1
DWRITE"AUTO PROGRAM RUNNING"
DPCUR2,1
DWRITE"PUSH PAUSE TO STOP MOTION"
GOTO LOAD
END
DEL LOAD
DEF LOAD
OUT1X1X
```

-continued

```
DLEDXXXX1X1X
T2
GOSUB ALOAD
END
DEL ALOAD
DEF ALOAD
OUTX1IXX
DLEDXXXXX1XX
T1.5
OUT0XXX
DLEDXXXX0XXX
T.5
OUTX0XX
DLEDXXXXX0XX
D(VAR9),0
GO
IF(IN=B11)
GOTO LOAD
NIF
PSET0,0
GOTO AMAKE
END
DEL AMAKE
DEF AMAKE
D(VAR6),(VAR6)
OUT1XXX
DLEDXXXX1XXX
T.2
OUT0XXX
DLEDXXXX0XXX
REPEAT
T.1
OUTXXX1
DLEDXXXXXXX1
T.25
OUTXXX0
DLEDXXXXXXX0
WAIT(IN=BOX)
GO
UNTIL(2PM>82000)
OUT1X0X
DLEDXXXX1X0X
REPEAT
T.1
OUTXXX1
DLEDXXXXXXX1
T.25
OUTXXX0
DLEDXXXXXXX0
WAIT(IN=BOX)
GO
UNTIL(IN=B11)
OUT0XXX
DLED0XXXXXXX
PSET0,0
REPEAT
T.1
OUT1XX1
DLEDXXXX1XX1
T.25
OUTXXX0
DLEDXXXXXXX0
WAIT(IN=BOX)
GO
VAR12=2PM+VAR6
UNTIL(VAR12>VAR11)
DO,100000
GO
OUTXX1X
DLEDXXXXXX1X
GOTO ALOAD
END
DEL COILS
DEF COILS
DCLEAR0
DPCUR1,2
DWRITE"ENTER LENGTH OF PART"
DLEDX1XXXXXX
DPCUR1,23
VAR13=DREAD
DPCUR2,2
DWRITE"ENTER DISTANCE BETWEEN PARTS"
```

-continued

```
DLEDXX1XXXXX
DPCUR2,31
VAR14=DREAD
VAR15=VAR13*6175
VAR16=VAR14*6175
VAR17=VAR16+VAR17
D(VAR17),(VAR17)
DCLEAR0
DPCUR1,1
DWRITE"PUSH F1 TO RUN SETUP"
DPCUR2,1
DWRITE"PUSH F2 TO RUN AUTO"
DLEDXXX1XXXX
VAR18=DREADF
IF(VAR18=1)
GOTO CRUN
NIF
IF(VAR18=2)
GOTO ARUN
NIF
END
DEL CRUN
DEF CRUN
OUT1X1X
DLEDXXXX1X1X
PSET0,0
DPCUR1,10
DWRITE"INSERT MATERIAL"
DPCUR2,10
DWRITE"PRESS F1 WHEN READY"
VAR19=0
VAR19=DREADF
WAIT(VAR19=1)
OUT0XXX
DLEDXXXX0XXX
L20
WAIT(IN=B00)
GO
IF(2PM>82000)
OUTXX0X
DLEDXXXXXX0X
NIF
LN
GOTO COILS
END
DEL ACRUN
DEF ACRUN
T3
D(VAR17),(VAR17)
REPEAT
T.1
OUTXXX1
DLEDXXXXXXX1
T.25
OUTXXX0
DLEDXXXXXXX0
WAIT(IN=BOX)
GO
UNTIL(IN=B11)
GOTO CRUN
END
```

In operation, it has been assumed that the strip stock 26 is to be fed to the machine 12, which in this example is a punch press for stamping predetermined patterns out of strip stock. The controller 22 is properly programmed for size and spacing and air pressure source 24 can function in response to controller 22 to operate the various air cylinders. Also, the gear motors 120 and 156 of roll feed entry 14 and roll feed exit 16 are energized and operated under the control of controller 22. The strip stock 26 is loaded onto the lift shelf 30 between guide bars 34 with the forward edges aligned up to the top edge of insert panel 184 and situated immediately in front of the upper entry guide 78 and lower entry guide 80. See FIG. 1.

The air cylinder 96 receives a one-way connection from air pressure source 24 so that it actuates vacuum cup 86 as a suction pick-up of the top strip 59. As shown in FIG. 3, the air cylinder 96 draws the vacuum adaptor 92 upward approximately three-quarters of an inch and, synchronous with that time, the air cylinder 88 is energized to draw the piston rod 90 inward thereby bringing the elbow carriage 102 and support arm 98 leftward (FIG. 2) which brings the top strip 59 up across the lower entry guide 80 for entry into the rollers 70 and 72. Rollers 70 and 72 grip the strip tightly as air cylinders 110 and 112 urge upper roller 70 downward, and the gear motor 120 under control of controller 22 provides controlled rotary motion to rollers 70 and 72 thereby bringing the strip through exit guides 82 and 84 and into stamping position of press 12. The strip 59 makes incremental advances which are programmed to be sufficient that the strip 59 advances just enough to provide full material for stamping without overlap or waste of strip material.

The operating strip 59 is then rolled across into the exit rollers 132 and 134 under control of air cylinders 146 and 148. The dual roller moving proceeds through the press 12 target or work space intermittently as the punched blank is moved leftward (FIG. 1). When the back end of operative strip 59 clears the entry rollers 70 and 72, the exit rollers 132 and 134 continue to draw the strip 27 through at the same rate to finish stamping of the strip 59 to the very end, whereupon rollers 132 and 134 release the punched blank out leftward into a hopper, trash receptacle or other remnant collector.

Strip material 26 when loaded onto the shelf 30 (FIG. 1) under control of material lift 40, is level controlled by means of microswitch 50. Thus, after the top strip 59 of strips 26 has been picked up by the vacuum cup 86 and carried leftward onto the lower entry guide 80, punch operation proceeds until the rightward end of strip 27 clears the feeler of microswitch 50. At this time, the material lift 40 actuates to index the arms 42 and 44 upward by an amount which is the thickness of an individual strip 59, and the next succeeding strip is at the proper level for pick-up by the vacuum cup 86 for entry into entry guides 78 and 80.

The foregoing discloses a feed mechanism which is capable of presenting either strip stock or coiled stock material for input to the operating point of a designated machine, and the feed system is capable of supplying input material incrementally with minimal loss of material during such as punch operations. In addition, the apparatus includes a push and pull roller system for receiving the strip stock therethrough while allowing complete machine operation from end to end of the strip stock. An adjustable centralizing guide functions in coaction with a material lift assembly for incrementally lifting strip stock into insertion position and carrying out insertion to the work area of the associated machine in continually centralized relationship thereto.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A feed system for moving strip stock through the work position of a machine, comprising:

first means for presenting the strip stock at a predetermined level;

centralizing guide means secured to the machine and operative to receive and maintain alignment of the strip stock relative to said machine, said centralizing guide means having first side and second side guide rails disposed in parallel and in vertical alignment and being adjustable to receive the strip stock closely therethrough;

adjustment means including a hand wheel for simultaneously moving the first and second guide rails in opposite directions relative to a center position therebetween;

a stop rail disposed vertically at said center position and terminating on the upper end at the predetermined level of said first means;

means directing the strip stock from the centralizing guide means to the machine;

entry guide means including a pair of rollers for seizing the strip stock from said means directing and pushing the stock through said work position; and exit guide means including a pair of rollers for seizing the strip stock after passage through said work position and pulling the strip stock therefrom.

2. The feed system as set forth in claim 1 wherein said means directing comprises:

an air cylinder with piston rod extensible between extended and contracted positions; and vacuum pick up means slidably supported for reciprocal movement along a slide rail, said vacuum pick up means being connected to said piston rod and energizable to pick up strip stock for movement between an extended rod pick up position over the centralizing guide means and a contracted rod release position over said entry guide means.

3. The feed system as set forth in claim 1 wherein said first means comprises:

a lift mechanism having an elongate shelf supported horizontally and being incrementally vertically movable while holding a stack of strip stock in said centralizing guide means between said first and second side guides; and means controlling incremental movement to maintain the topmost strip of said strip stock at said predetermined level.

4. The feed system as set forth in claim 1 wherein said entry guide means comprises:

a lower guide plate receiving the strip stock thereacross;

an upper guide plate disposed over the lower guide plate receiving the strip stock thereunder leave in an upper and a lower roller disposed to receive the strip stock securely for movement therebetween; and air cylinder means energizable to control downward tension on said upper roller.

5. The feed system as set forth in claim 4 wherein said exit guide means comprises:

an upper and a lower roller disposed to receive the strip stock after passage through the work position and to move the strip stock through said upper and lower rollers; and an air cylinder means energizable to control downward tension on said upper roller.

6. The feed system as set forth in claim 1 wherein said exit guide means comprises:

an upper and a lower roller disposed to receive the strip stock after passage through the work position and to move the strip stock through said upper and lower rollers; and air cylinder means energizable to control downward tension on said upper roller.

7. A feed system for moving strip stock through a repetitive punch press machine, comprising:

means presenting the strip stock to the machine in unstamped form;

entry roller means pneumatically energized to grip said strip stock and push the strip stock through the punch press operative position;

exit roller means pneumatically energized to grip said remnant strip stock and pull the remnant strip stock from the punch press operative position;

an elongate horizontal air cylinder disposed adjacent and perpendicular to said entry roller means and having a piston rod end extendable toward said means presenting the strip stock and contractible toward the entry roller means;

a vacuum cup affixed to said piston rod end and energizable to pick up said strip stock and carry it from extension through the contraction stroke of said air cylinder thereby to advance the strip stock through said entry roller means; and controller means programmed for timed operation to energize said pneumatic means, entry roller means, and exit roller means.

8. A feed system as set forth in claim 7 which is further characterized to include:

a centralizing guide receiving the unstamped strip stock for alignment at the machine entry level for subsequent vacuum pickup by said pneumatic means.

9. A feed system as set forth in claim 8 wherein said means presenting comprises:

material lift means having a generally horizontal shelf which is drivable vertically in selected increments and serves to carry a stack of plural strips of stock; and level sense means in contact with the topmost strip to maintain the level of the topmost strip continually.

10. A feed system as set forth in claim 8 wherein said entry roller means comprises:

entry guide means receiving said strip stock from the pneumatic means;

a seated lower roller adjacent said entry guide means receiving said strip stock;

an upper roller disposed over said lower roller and supported rotatably at each end from a horizontally disposed slide bar; and entry air cylinders energizable to depress the upper roller against the lower roller.

11. A feed system as set forth in claim 10 wherein said exit roller means comprises:

a seated lower roller;

an upper roller disposed over said lower roller as supported rotatably at each end from a horizontally disposed slide bar; and exit air cylinders energizable to depress the upper roller against the lower roller to seize the strip stock securely.

12. A feed system as set forth in claim 8 wherein said exit roller means comprises:

a seated lower roller;

an upper roller disposed over said lower roller as supported rotatably at each end from a horizontally disposed slide bar; and exit air cylinders energizable to depress the upper roller against the lower roller to seize the strip stock securely.

13. A feed system for moving strip stock as set forth in claim 7 wherein said controller means further comprises:

program control for energizing the pneumatic means to attach to the strip stock and move the strip stock into engagement with the entry roller means;

second program control energizing a pair of entry air cylinders to increase tension of entry rollers to grip said strip stock;

third program control energizing the entry rollers to push the strip stock into the punch press operative position; and fourth program control energizing the exit rollers after the punch press operation to grip the strip stock and pull the strip stock a pre-programmed distance from said operative position.

* * * * *